United States Patent [19]

Pedersen

[11] Patent Number: 4,732,172

[45] Date of Patent: Mar. 22, 1988

[54] APPARATUS FOR WASHING TRANSFER CARTS

[75] Inventor: Gerald D. Pedersen, Cannon Falls, Minn.

[73] Assignee: Cannon Equipment Company, Cannon Falls, Minn.

[21] Appl. No.: 784,928

[22] Filed: Oct. 4, 1985

[51] Int. Cl.[4] ..... B08B 3/02

[52] U.S. Cl. ..... 134/62; 134/129; 134/200

[58] Field of Search ..... 134/45, 61, 62, 83, 134/123, 129, 134, 144, 148, 151, 152, 167, 172, 200; 15/104.05; 239/450; 118/306, 317, 315

[56] References Cited

U.S. PATENT DOCUMENTS

| | | | |
|---|---|---|---|
| 3,022,791 | 2/1962 | Larson | 134/200 |
| 3,096,775 | 7/1963 | Clarke et al. | 134/123 |
| 3,163,149 | 12/1964 | Ivey | 134/199 X |
| 3,289,238 | 12/1966 | Sorenson et al. | 134/123 X |
| 3,444,867 | 5/1969 | Thornton | 134/123 |
| 3,698,029 | 10/1972 | Pulliam | 134/180 X |
| 3,706,317 | 12/1972 | Fox et al. | 134/129 X |
| 3,736,948 | 6/1973 | Crosswhite | 134/123 X |
| 4,408,625 | 10/1983 | Kuhl | 134/123 X |
| 4,452,263 | 6/1984 | McClure | 134/152 X |

*Primary Examiner*—Harvey C. Hornsby
*Assistant Examiner*—Frankie L. Stinson
*Attorney, Agent, or Firm*—William C. Flynn; Henry C. Kovar

[57] ABSTRACT

A method and apparatus for washing transfer carts, the method having the steps of placing the cart on an advancement conveyor and advancing the cart into a soak station for soaking with a soak solution; advancing the cart into the wash station where a plurality of nozzle carrying wash arms are extended through an open side of the cart spraying a high pressure washing solution at an angle onto each of the respective shelves of the cart after which the washing nozzles are retracted again passing over the respective cart shelves; advancing the cart into a rinse station, rinsing the cart first with clear water and then with a dilute acid solution; and advancing the cart from the apparatus. The apparatus has a soak station with an array of soak nozzles; a wash station with a plurality movable wash arms each carrying multiple aimed spray nozzles for washing the shelves by extending into each interspace between all of the cart shelves; a rinse station with an array of rinse nozzles; and an advancement mechanism for advancing the cart through the apparatus.

13 Claims, 6 Drawing Figures

APPARATUS FOR WASHING TRANSFER CARTS

BACKGROUND OF THE INVENTION

1. Field of the Invention

The present invention relates to a method and an apparatus for cleaning and sanitizing transfer carts used in the dairy industry.

2. Description of the Prior Art

It has become a common practice to ship packaged products such as milk and the like using reusable transfer carts. The use of transfer carts increases productivity and decreases the costs of distribution by minimizing handling of the product containers in the distribution chain. With continued use, however, the carts become soiled from handling, spillage, and storage.

A typical transfer cart is a five-shelved rectangular cart mounted on caster wheels for easy movement. The carts are usually constructed from stainless steel.

When milk or other dairy products are shipped using transfer carts, the cleaning becomes an acute problem. Milk, being of product for human consumption requires a much higher level of cleanliness and sanitation than a non food product. Additionally, milk containers typically will leak leaving milk on the transfer cart to dry and spoil. Spillage presents a liquid which will both collect dust, frass, and other accumulate from the environment and provide a biologically active medium attracting insects and growing bacteria. Continued use of the transfer carts and therefore continued collection of accumulate without cleaning produces a transfer cart that is both cosmetically unsightly and may be a health hazard.

Previously, transfer carts have been washed by hand expending large amounts of time and greatly increasing labor costs. Even with the large expenditures necessitated in hand washing, the results have not been satisfactory. The transfer carts are typically fabricated multiple pieces of stainless steel stock welded together forming the cart. With this construction, there are a multitude of difficult to clean crevices which often were not adequately cleaned. Additionally, stronger cleaning solutions and hotter water which could be used to more effectively clean the transfer carts are incompatible with hand cleaning.

The known prior art has not been able to effectively overcome the cleaning and sanitation problems.

OBJECTS OF THE INVENTION

It is an object of the present invention to provide an improved method and apparatus for rapidly cleaning and sanitizing transfer carts.

It is another object of the present invention to provide a method and an apparatus to clean transfer carts by passing the carts through a soak station, a washing station and a rinse station.

It is another object of the present invention to provide a method and an apparatus that tilts the transfer carts while washing and rinsing the carts.

It is another object of the present invention to provide a method and an apparatus that washes transfer carts by moving an extendible washing mechanism proximately over each shelf of the cart scrubbing the shelves.

It is the further object of the present invention to provide an apparatus that effects complete coverage of the transfer carts with the soak solution and the rinse solution.

SUMMARY OF THE INVENTION

In accordance with the principles of the present invention, a method for cleaning transfer carts has the steps of moving the cart into and securing the cart in a washing position, moving an extendible washing mechanism from an open side of the cart proximate to each shelf surface, retracting the washing mechanism, and releasing the cart from the washing position.

The cleaning method soaks an upright cart in a soaking solution to facilitate removal of accumulate, tilts the cart for washing and rinsing, and unloads the cart to an upright position.

The cleaning apparatus has a washing station where the cart is secured for washing, and a multiple shelf washing mechanism which advance across each shelf surface washing each shelf surface.

The cleaning apparatus has a soak station, a wash station, and a rinse station. A cart trackway extends through the three stations, carrying the cart upright in the soak station and tilted in both the wash station and the rinse station.

An enclosed passageway passes through the soak station, the wash station, and the rinse station. Within the soak station of the passageway, a soak solution is sprayed coveringly onto the cart. Similarly, within the rinse station of the passageway, a rinse solution is sprayed onto the cart.

These and other manifestations of the invention will become realized and appreciated upon review and use of the teachings herein.

DESCRIPTION OF THE PREFERRED EMBODIMENT

Figure 1:
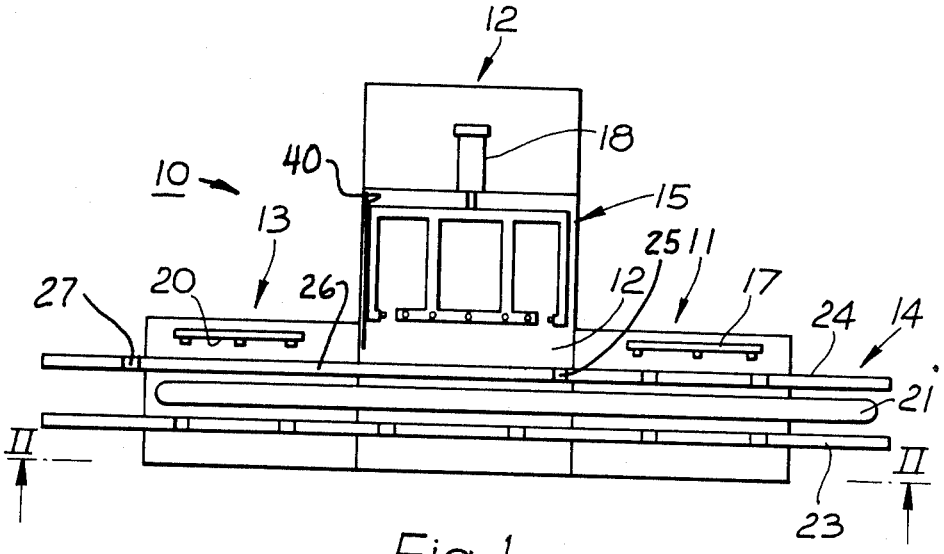
FIG. 1 is a plan overhead partially cutaway view showing the interior mechanisms of the cart cleaner.
Figure 2:
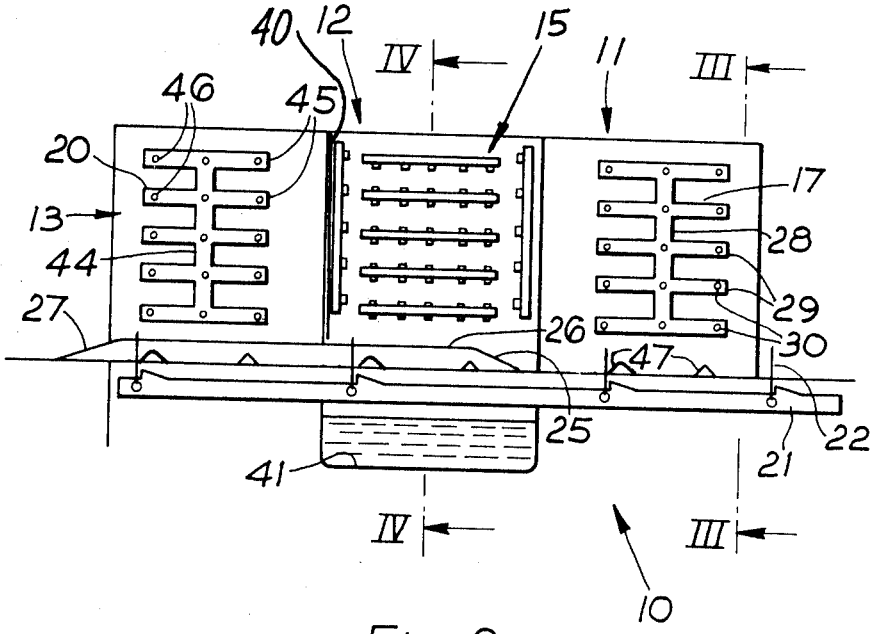
FIG. 2 is horizontal plan view of the interior of the cleaner taken approximately at II—II of FIG. 1.
Figure 3:
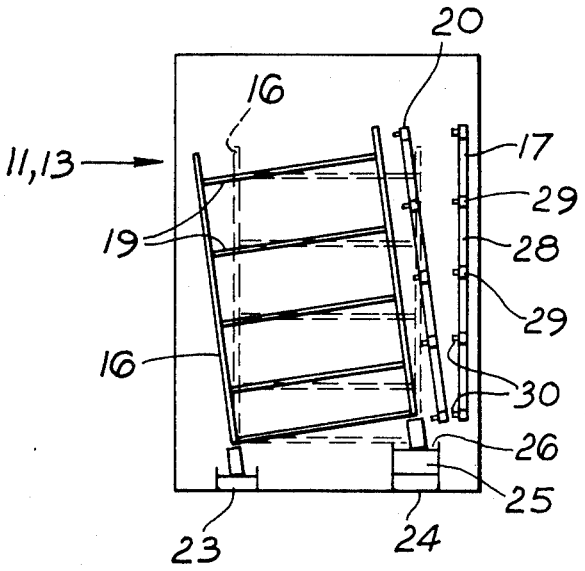
FIG. 3 is a partial cross sectional view of the rinse station of the cart cleaner taken approximately at III—III of FIG. 2 showing a cart in rinsing position.
Figure 4:
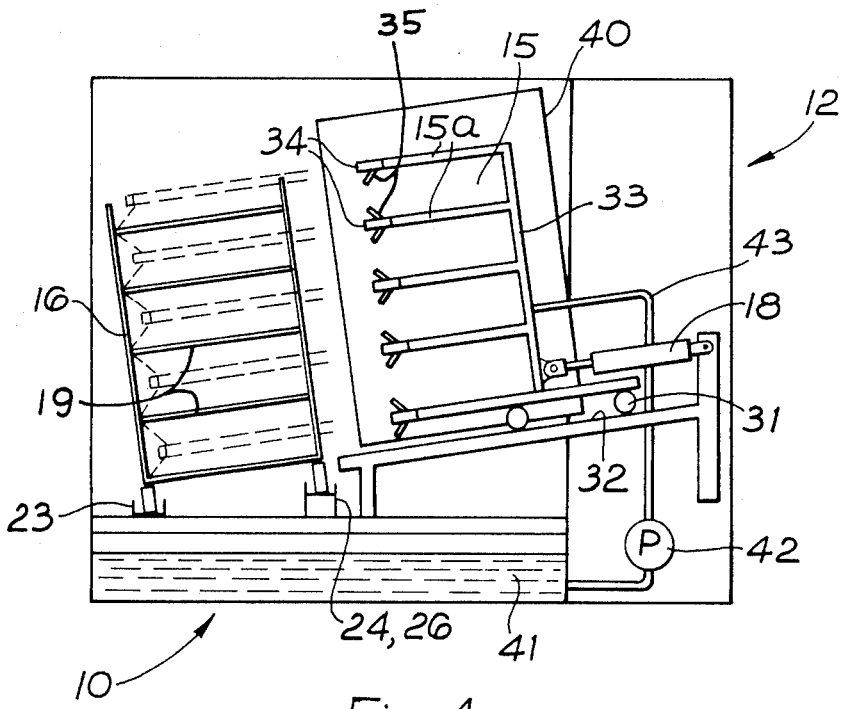
FIG. 4 is a partial cross sectional view of the wash station of the cart cleaner taken approximately at IV—IV of FIG. 2.
Figure 5:
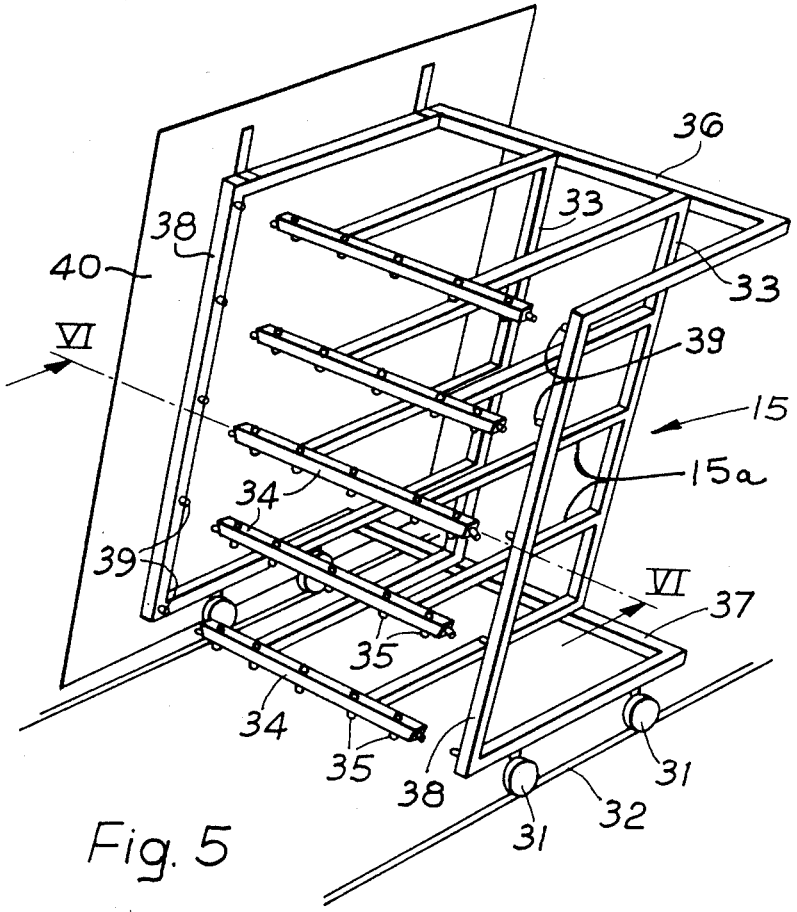
FIG. 5 is a partial perspective view of the washing chassis mechanism in the wash station.
Figure 6:
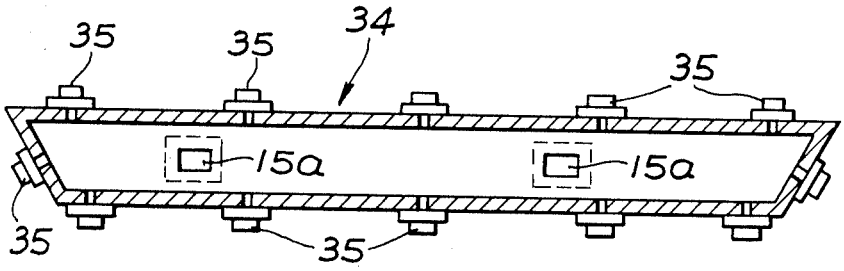
FIG. 6 is an enlarged detail cross sectional view of one washer head crossbar taken approximately at VI—VI of FIG. 5.

The cart cleaner 10 has three stations, a soak station 11, an wash station 12, and a rinse station 13. A trackway 14 passes through the soak station 11, the wash station 12, and the rinse station 13 of the cart cleaner 10.

The soak station 11 extends upwardly over the trackway 14 enclosing a cart 16 and locating the cart 16 to be sprayed with a soak solution from the soak nozzle array 17. After the cart 16 has been soaked in the soak station 11, the cart 16 is moved into the wash station 12.

In the wash station 12, a movable washer chassis mechanism 15 with multiple washing arms **15*a* envelopes the cart 16 with the pressurized washing solution. The washer chassis 15 is moved using an air driven cylinder 18 to move each of the multiple washing arms 15*a* across the respective surfaces of the cart shelves 19**.

After removal from the wash station 12, the cart 16 enters the rinse station 13 where the rinse nozzle array 20 sprays the cart 16 with the rinse solution removing the residual washing and soaking solutions.

Disposed beneath and cooperating with the trackway 14 is a cart advancement mechanism 21 having multiple upwardly extending retractable pawls 22 for engaging the carts 16 at multiple points on the trackway 14. The advancement mechanism 21 reciprocates so on the forward stroke, the pawls 22 engage a cart 16 and advance the cart 16 along the length of the trackway 14. On the return stroke of the advancement mechanism 21 the pawls 22 retract passing by the cart 16 and thence again extend to engage the next cart 16. The advancement mechanism 21 may be powered in numerous ways and is preferably powered using a dual action air driven cylinder.

The trackway 14 consists of two parallel tracks 23, 24, the first track 23 being rectangular "U" shaped track extending horizontally the length of the cleaner 10. The second track 24 also has a rectangular "U" shaped cross section and extends the length of the cleaner 10. The second track 24 further has a first inclined segment 25 between the soak station 11 and the wash station 12 leading onto the raised tilted segment 26 of the track 24. The tilted segment 26 extends through the wash station 12 and the rinse station 13 and joins a second inclined segment 27 at the end of the rinse station 13.

The soak station 11 has the soak nozzle array 17 attached and preferably bolted, to an inner wall. The soak nozzle array 17 has an inlet manifold 28 connected to a pressurized supply of soak solution and communicating the soak solution through the inlet manifold 28 and into the multiple co-planar manifold branches 29. The branches 29 communicate the soak solution along their length and into multiple soak nozzles 30 for spraying onto the cart 16 in the soak station 11.

The wash station 12 contains the movable washer chassis 15 which reciprocates on wheels 31 cooperating with the inclined chassis trackway 32 in response to the urgings of the chassis cylinder 18. Attached to the chassis 15 are a pair of vertical manifolds 33 and attached to each vertical manifold 33 is a plurality of horizontal washing arms 15*a*. A wash nozzle arm 34 is attached at the terminus of each pair of washing arms 15*a* and is co-planer with the respective pair of washing arms 15*a*. Each nozzle arm 34 is hollow and has a plurality, preferably five, wash nozzles 35 attached on its upper and lower sides. The nozzles 35 are disposed to provide a spray sheet 48 parallel to each respective nozzle arm 34 and at an angle 49 between the spray sheet and the plane of the attached washing arms 15*a* approaching ninety degrees and preferably eighty-five degrees. Each nozzle arm 34 further has diagonal ends with a an end nozzle 35*e* attached thereon and spraying outwardly.

The vertical manifolds 33 terminate in a top crossbar 36 and a bottom crossbar 37. The crossbars 36,37 carry the inward sprayers 38 which are located having their nozzles 39 opposing the end nozzles 35*e* of each nozzle arm 34.

A spray shield 40 is attached to the outer side of the inward sprayer 38 adjacent the rinse station 13. The spray shield 40 is a planar sheet of material, preferably stainless steel which segregates the wash solution spray in the wash station 12 from the rinse solution in the rinse station 13.

The wash solution is collected in a pool 41 beneath the wash station 12 and communicated to a pump 42 where the wash solution is pressurized and further communicated through lines 43 to the vertical manifolds 33 and thence through the wash arms 15*a* and into the nozzle arm 34. The wash solution is sprayed through the nozzles 35, 35*e*, 39 and onto a cart 16. A majority of the wash solution drips from the cart 16 into the pool 41 and is recycled through the pump 42 and reused.

The rinse station 13 has the rinse nozzle array 20 attached and preferably bolted, to an inner wall. The rinse nozzle array 20 has an inlet manifold 44 connected to a pressurized supply of rinse solution and communicating the rinse solution through the inlet manifold 44 and into the multiple co-planar manifold branches 45. The plane of the nozzle array 20 is further located to be parallel to the side of the tipped cart 16 positioned in the rinse station 13. The branches communicate the rinse solution along their length and into multiple rinse nozzles 46 for spraying onto the cart 16 in the rinse station 11.

In its use, the cart cleaner 10 is installed in a suitable location. A cart 16 is placed sufficiently on the trackway 14 to engage the pawls 22 on the lower frame of the cart 16. As the advancement mechanism 21 cycles, it moves the cart 16 into the soak station 11 where a soak solution is sprayed onto the cart 16 from the soak nozzles 30. While in the soak station 11, the cart 16 is positioned and restrained having its wheels adjacent the cart stop and hold detents 47*s* in the trackway 14.

The next cycle of the advancement mechanism 21 moves the cart 16 over the first incline 25 into a tilted position and into the wash station 12 where the cart 16 is again positioned and restrained by having its wheels adjacent detents 47*w*.

In the wash station 12, the washer chassis 15 is urged forward by the chassis cylinder 18 and the wash arms 15*a* are extended respectively between each of the shelves 19 of the cart 16. Wash solution is sprayed from the extending nozzles 35, 35*e* of the nozzle arm 34 attached to each wash arm 15*a* onto each shelf 19 of the cart 16, and also inward upon the outside of the cart 16 from inward nozzles 39. The washing solution is sprayed at high pressure and at a predetermined angle onto the shelves 19 and the cart 16 cleaning the accumulate therefrom.

The connected inward sprayers 38 also advance along the outsides of the cart 16 cleaning the accumulate from the outer surfaces and the inward spray of the inward sprayers 38 cooperates with the outward spray from the nozzle arm 34 end nozzles 35*e* to create turbulence and a spray pattern which more efficiently cleans the outer surfaces of the cart 16. Additionally, the cooperation between the inward sprayer nozzles 39 and nozzle arm 34 end nozzles 35*e* produces a liquid curtain retaining most of the wash solution within the wash station 12. The remainder of the overspray from the wash station 12 is deflected back and downwardly by the spray shield 40 to the wash solution pool 41 thus preventing wash solution migration into the rinse station 13.

After being fully extended, the washer chassis cylinder 18 retracts the washer chassis 15 causing the spray nozzles 35, 39 to again spray over the entire surface of the cart 16 further washing the cart 16. With the chassis fully retracted, the washing is completed.

As the advancement mechanism 21 cycles, it moves the cart 16 into the rinse station 13 where a rinse solution is sprayed onto the cart 16 from the rinse nozzles 46. While in the rinse station 13, the cart 16 is restrained having its wheels adjacent the detents 47 in the trackway 14.

Rinsing the cart 16 is preferably a two step procedure where the cart is first rinsed with clear water for the two-thirds of the time and, second, rinsed with a dilute acid solution for the remainder of the cycle.

It is understood that cleaning the carts 16 in the cleaner 10 is a continuous process where one cart 16 enters the soak station 11 of the cleaner 10 while a previous cart 16, now cleaned, is removed from the rinse station 13.

These advantages, usages and many other usages will be found and realized by those versed in the art, and although various minor modifications may be suggested and employed by those who are versed in the art, be it known that I wish to embody within the scope of the patent granted hereon all such embodiments as reasonably come within the scope of my contribution to the art.

I claim as my invention:

1. An apparatus for cleaning a transfer cart comprising:

(a) a discrete soak station having means for spraying a soaking solution upon a cart therein;

(b) a discrete washing station following said soak station;

(c) means for automatically advancing the cart from the soaking station to the washing station;

(d) means for securing the cart in a fixed position in the washing station;

(e) a washer chassis fixed in and with respect to said washing station;

(f) cart washing means for washing the cart, said washing means having a plurality of discrete shelf washing means for cleaning individual shelves of the cart, said cart washing means being movably mounted on said washer chassis and having a discrete shelf washing means for the top surface and the bottom surface of each cart shelf;

(g) automatic advance means connected to said cart washing means and said washer chassis for automatic advancing said cart washing means into said cart and for advancing said shelf washing means across the extent of each respective shelf, said advance means having means for retracting said cart washing means from said cart after said shelf washing means having been advanced across the respective shelves;

(h) a discrete rinse station following said washing station;

(i) said cart advancing means including means for automatically advancing a washed cart from the washing station to the rinse station; and (j) means for preventing wash solution migration to the rinse station during washing.

2. The apparatus for cleaning transfer carts according to claim 1, wherein the washer chassis and the movable washing means thereon are both tilted at a downward angle, wherein said washing station includes means for automatically tilting the cart away from the washer chassis and washing means.

3. The apparatus for cleaning transfer carts according to claim 1, wherein the washing means further comprises a multi-armed nozzle array, each arm having a multiplicity of nozzles affixed thereon with a plurality of said nozzles being disposed downwardly on and from each respective arm to provide a spray sheet for cleaning the top surface of a respective cart shelf, and a plurality of said nozzles being disposed upwardly on and from most of said arms to provide a spray sheet for cleaning the bottom surface of each of the upper cart shelves.

4. The apparatus for cleaning transfer carts according to claim 3, further comprising a planar spray shield attached to one side of said washing means, whereby with said washing means advanced, said spray shield temporarily essentially closes said wash station from said rinse station.

5. The apparatus for cleaning transfer carts according to claim 1, further comprising:

(a) a horizontal cart trackway leading to and extending through the soak station;

(b) a ramped and tilted continuation of the trackway for tilting the carts during passage into and through the wash station;

(c) said tilted trackway further continuing through the wash station and the rinse station; and (d) means for returning the tilted carts to horizontal and for removing the carts from said apparatus.

6. The apparatus for cleaning transfer carts according to claim 5 further comprising a means for collecting the soak solution under the wash station.

7. The apparatus for cleaning transfer carts according to claim 5 wherein the ramped continuation of the trackway tilts the carts in the range of three degrees to ten degrees.

8. The apparatus for cleaning transfer carts according to claim 7 wherein the trackway maintains the cart tilt through the wash station.

9. A T-shaped apparatus for cleaning shelved transfer carts comprising (a) a soak station, a wash station and a rinse station arranged in this order in a straight line forming the top of the T-shape;

(b) a fixed cart track extending through the soak, wash and rinse stations;

(c) a relatively fixed washer trackway, a relatively movable washer chassis mounted on said trackway, and an actuator mounted between the trackway and the chassis for moving the chassis back and forth on the trackway and transversely in over and back off of the cart track, said trackway and washer;

(d) means in said stations for automatically advancing a cart from the soak to the wash station, and then from the wash to the rinse station;

(e) front and rear side walls on both sides of the soak and rinse stations respectively, and a side wall on the front side of the wash stations, said front side walls being co-planar;

(f) a pocket extending transversely rearward of the wash station, said pocket forming the base of the T-shape with said washer trackway being in said pocket and said washer chassis normally being in said pocket;

(g) pocket walls extending from the rear side walls and enclosing the pocket; and (h) a transversely movable spray shield for blocking the wash station from the rinse station, said shield being mounted on and being co-movable with said washer chassis.

10. The apparatus of claim 9 in which said washer trackway is inclined downwardly toward said cart track, said cart track being tilted in said wash station at an angle generally the same as the inclined trackway.

11. The apparatus of claim 10, in which said cart trackway is level and generally horizontal in said soak zone, said track having a segment inclined upwardly from the soak to the wash station.

12. The apparatus of claim 9, including means for recycling the soak solution in the wash station.

13. The apparatus of claim 9 in which the washer chassis has a plurality of nozzle arms for entering into the cart between adjacent shelves of the cart, each arm having discrete spray nozzles position to spray up, down and transversely outward, said washer chassis further including inward sprayers which go around and to the outside of the cart, said inward sprayers each having spray nozzles positioned to spray inwardly upon the outside of the cart.

* * * * *